United States Patent [19]

Sato

[11] Patent Number: 4,548,407

[45] Date of Patent: Oct. 22, 1985

[54] TOSS BATTING TRAINER

[76] Inventor: Kazuhiro Sato, 7-39 chome, Kyokunan, Akita City, Akita 010, Japan

[21] Appl. No.: 480,583

[22] Filed: Mar. 30, 1983

[30] Foreign Application Priority Data

Apr. 8, 1982 [JP] Japan ..... 57-52057[U]

[51] Int. Cl.[4] ..... A63B 69/40

[52] U.S. Cl. ..... 273/26 R; 273/29 A; 124/1; 124/50

[58] Field of Search ..... 273/26 R, 26 D, 201, 273/29 A; 124/1, 81, 49, 50

[56] References Cited

U.S. PATENT DOCUMENTS

| | | | |
|---|---|---|---|
| 2,071,356 | 2/1937 | Pagett | 273/201 |
| 2,171,299 | 8/1939 | Beckett | 273/201 |
| 3,003,770 | 10/1961 | Jones | 273/201 |
| 4,132,214 | 1/1979 | Schnurr | 124/1 |
| 4,265,453 | 5/1981 | Loof | 273/201 |

FOREIGN PATENT DOCUMENTS

| | | | |
|---|---|---|---|
| 926492 | 5/1922 | United Kingdom | 273/26 R |
| 1110564 | 4/1968 | United Kingdom | 273/201 |

*Primary Examiner*—Richard C. Pinkham
*Assistant Examiner*—T. Brown
*Attorney, Agent, or Firm*—Staas & Halsey

[57] ABSTRACT

A ball tossing training device includes a ball receiver supported on a stand, a ball track feeder for receiving balls from the receiver, the inclination of the ball track feeder being ajustable to control the speed of a ball, a ball stopper for automatically intermittently feeding a single ball at a time along the track feeder and a ball tosser positioned below the discharge end of the track feeder for deflecting each ball discharged therefrom.

4 Claims, 2 Drawing Figures

TOSS BATTING TRAINER

BACKGROUND OF THE INVENTION

This invention relates to an improved structure of a toss batting trainer for supplying a ball automatically at a given height without requiring any external power and which has been developed chiefly for toss batting practice.

Various types of trainers for baseball previously have been developed such as pitching machines, tee batting machines and toss batting machines. Many such prior devices, however, depend on electric energy or other external power in order to operate. Consequently, not only are maintenance and operational expenses considerably high but also the training area to be used is limited to an area having a power source available. Moreover, the equipment itself becomes more complicated and expensive. Therefore, the real circumstances are such that these prior trainers are normally not familiar and obtainable even to a group of enthusiasts to say nothing of an individual.

SUMMARY OF THE INVENTION

An object of the present invention is to provide a ball tossing training device which manually automatically feeds a sequence of balls at spaced intervals to a trainee or other individual practicing a ball game.

Another object of the present invention is to provide a ball tossing training device wherein the speed and interval of the balls maybe easily adjusted.

A further object of the present invention is to provide a ball tossing training device which does not require electrical energy to be available to operate the device and which is moderate in cost and safe to operate.

According to the present invention, the foregoing objects are attained by providing a ball tossing training device which includes a ball receiver mounted on a self-supporting stand above ground level. An angularly adjustable ball track feeder having a meander portion between its loading end and its discharge end is provided for receiving balls from the ball receiver. Means are further provided for adjusting the inclination of the ball track feeder to control the speed of a ball moving therealong. The device further includes means for intermittently automatically feeding a single ball at a time along the track feeder and ball tossing means positioned below the discharge end of the track feeder for deflecting each ball discharged therefrom along a path a sufficient distance to reach a user of the device. The ball tossing means may be adjusted to change the angle and direction of each ball deflected therefrom.

Other features and advantages of the present invention would be apparent from the following description taken in conjunction with the accompanying drawings in which reference characters designate the same or similar parts throughout the figures thereof.

DESCRIPTION OF THE PREFERRED EMBODIMENTS

Figure 1:
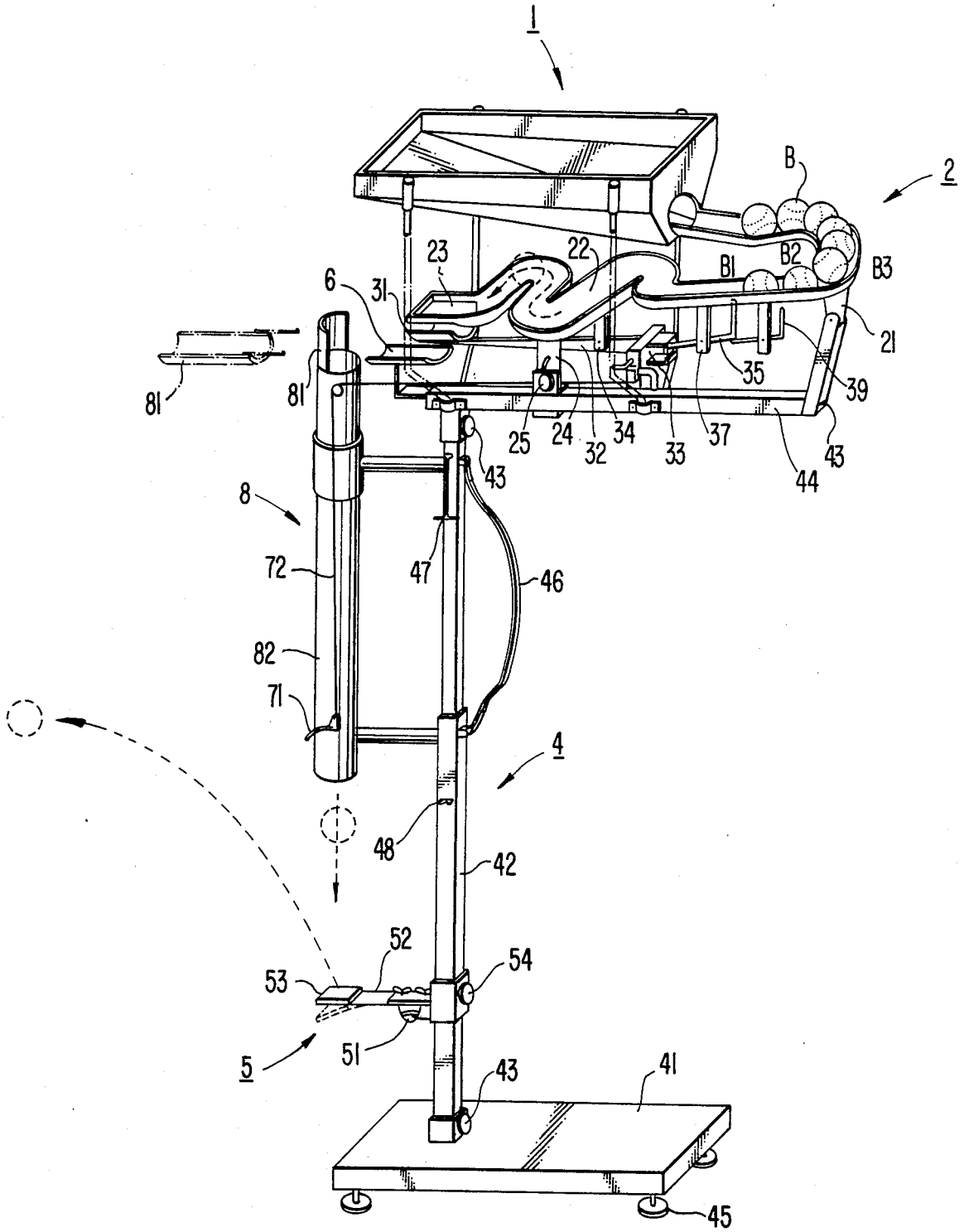
FIG. 1 is a general perspective view of a toss batting trainee, according to the present invention.
Figure 2:
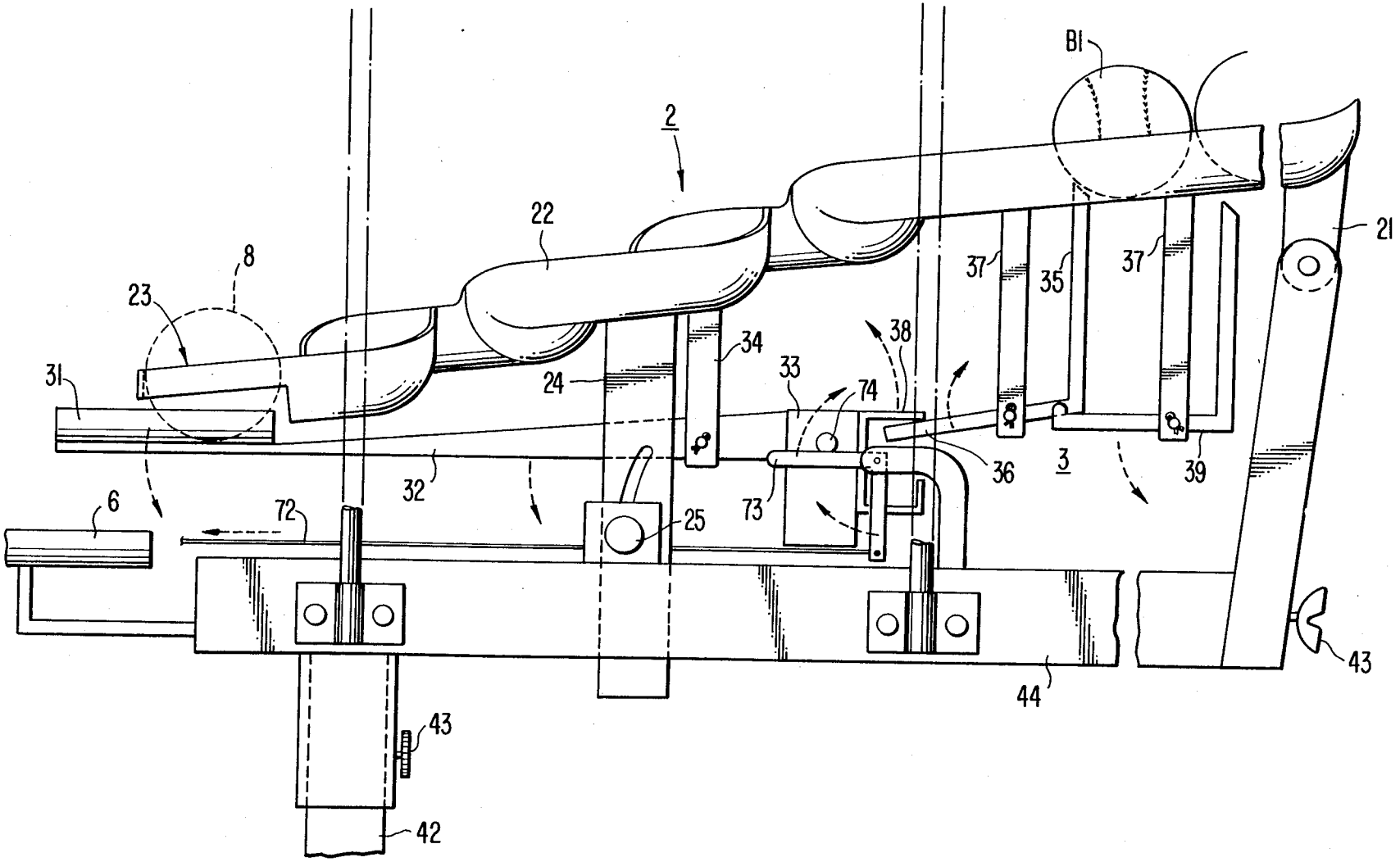
FIG. 2 is an enlarged side view of the ball track feeder portion of the present invention.

As will be understood from representative embodiments which are illustrated in the accompanying drawings, a toss batting trainer according to the present invention comprises basically a ball track feeder 2, an intermittent ball feeder 3, a self-supported stand 4 for supporting the above two feeders, and a resilient ball tosser 5.

The ball track feeder 2 has a receiving end and a discharge end and is comprised of a ball receiver 1 and a meander 22 for keeping the interval of feeding balls on the way. The ball track feeder 2 is supported adjacent its receiving end by a pivotal part 21 and at the opposite discharge end is provided with a ball holding hole 23. The ball track feeder 2 further is supported at its midportion by a regulating rod 24 which is vertically adjustable to vary the inclination of the feeder. The regulating rod 24 may be adjusted vertically by means of a clamp screw 25 attached to a horizontal arm 44 of the self-supported stand 4. By this means the overall inclination of the ball track feeder on the supporting point of the pivotal part 21 can be set freely at any angle, thereby adjusting the interval of feeding balls to that of being optimal according to the user's desire.

The intermittent ball feeder 3 includes a ball holder 31 arranged under the terminal ball holding hole 23 of the ball track feeder 2 and a ball stopper 35 postioned adjacent the front end of the ball track feeder, both being interlocked so that the stopper 35 will be released when a ball arrives at the ball holder 31 and the holder 31 drops due to the weight of the ball B. The interlocking mechanism has a weight 33 formed on the end of a horizontal rod 32 extending from the ball holder 31 toward the stopper 35. The horizontal rod 32 is pivotally supported by a shaft bearing rod 34 at a suitable portion. The arrangement is such that the ball holder 31 will remain close to the ball holding hole 23 at all times when a ball B is not placed on the holder 31. However, the holder 31 will come down against the weight 33 when a ball is on the holder.

The stopper 35 normally has its lower end 36 stopped by the lower surface of a guide piece 38 attached to the weight end of the horizontal rod 32. The stopper 35 is pivotally supported on a shaft bearing rod 37. Thus, the end 36 is kept depressed in a given position by the weight 33 mounted on arm 32 when a ball B is not placed on the ball holder 31 and thus the holder 31 is kept near to the ball holding hole 23, and the stopper 35 is kept projecting in a raised position adjacent the front of the ball track feeder 2. Under such state, therefore, the first ball B1 of a group of balls B, B . . . coming froom the ball receiver 1 is checked from running by the stopper 35. The stopper 35 can be released then temporarily by operation of a stopper release lever 71 formed on the batting trainee side when the ball B is not placed on the ball holder 31. In the drawings, the numeral 72 denotes a coupling rope, 73 denotes a moving piece to push up a receiving piece 74 provided on the weight 33, 38 denotes a guide piece to regulate a position whereat the weight 33 formed end is coupled to the stopper end 36, and further 39 denotes a stopper for regulating running of a second ball B2. The lower end of stopper 39 is in interlocking relationship with the stopper 35.

Thus, the weight 33 of the intermittent ball feeder 3 functions to restore the ball holder 31 and the stopper 35 to home positions. The weight can be replaced by, for example, a spring, hydraulic system, etc. which are available means to function similarly thereto.

The self-supported stand 4 comprises a table leg seat 41 provided with a caster with metal fixtures or legs 45 which are adjustable to level the stand. A main rod 42 projects upwardly from the leg seat 41 and horizontal arm 44 is connected to the main rod 42 for supporting the ball receiver 1, the ball track feeder 2, the ball intermittent feeder 3 and others. The main rod 42 is telescopically constructed so as to adjust the length. In the drawings, 43, 43 . . . denote clamp screws at each junction.

A bearing member 6 for regulating the drop position of the ball holder 31 and also for guiding the ball B to a drop starting point is arranged, as illustrated, on the tip of the horizontal arm 44. A guide tube 8 for regulating the direction of the ball B coming from the bearing member 6, is mounted on main rod 42. The guide tube 8 is divided into an upper catching part 81 and a straight part 82 coming thereunder for normal use. However, the catching part 81, may be detached, as shown by a one-dot chain line in FIG. 1, and connected directly to the bearing member 6 as occasion demands, to allow the ball B to run on the catching part 81 connected thus almost horizontally from the bearing member 6 and pass over the straight part 82, thus supplying the ball B directly from the front of the catching part 81. By use of this latter arrangement, the device may be used to practice batting the ball B directly as it drops without using a resilient ball tosser 5 described hereafter.

The resilient ball tosser 5 for deflecting a ball is disposed on the main rod 42 of the self-supported stand 4 or on a stabile leg seat 41 (not illustrated) and comprises a locked part 51 and a resilient member 52 angularly adjustably connected to the locked part 51. The resilient member 52 may be formed horizontally or slantingly somewhat with an adjusting screw 54 so that it will be positioned right under the guide tube 8 and capable of tossing the ball B in an optimal direction according to the trainee's position.

The resilient member 52 is formed with a steel plate or other material superior in resilience. However, there may be a case where a seam or other ruggedness on the ball B surface will give an indefinite direction of rebound from collision therewith. Therefore, a ruggedness absorbing member 53, such as a soft sponge, may be positioned on the surface of member 52 or a direction stabilizing guide piece or the like may be prepared (not so illustrated) circumferentially of the resilient member 52.

To commence a practice on the toss batting trainer constituted, as described above, the inclination of the ball track feeder and the inclination of the resilient member are first adjusted to an optimal state, thereby keeping a feed interval and a toss direction of the ball ready for a trainee, and then balls B, B . . . are fed into the ball receiver 1. The balls B run in a row from the start or loading end of the ball track feeder 2 until they reach the stopper 35, whereupon they stop. When a trainee posing in a given toss direction releases temporarily the stopper 35 by operating the stopper release lever 71 with a bat or other means, the extreme or first ball B1 runs toward the opposite end of the feeder 2, and the next ball B2 is stopped on the restored stopper 35. The time required for a ball to pass over the meander 22 is properly adjusted according to the inclination of the ball track feeder 2. After the ball B1 reaches the end of the meander 22, it moves onto the ball holder 31 through the ball holding hole 23. Then, the holder 31 begins to drop due to the weight of the ball B1 and arrives at the bearing member 6. The weight 33 correspondingly moves upward to release the stopper end 36 kept depressed so far thereby, and thus the balll B2 is allowed to run. In this case (as in the previous case, where the stopper 35 was temporarily released), the stopper 39, if provided as illustrated, pivots upwardly and functions to hold a ball B3 temporarily from running and prevent it from running out erroneously together with the ball B2. (The above situation is indicated by a dotted line in the drawing).

Simultaneously with the ball B2 commencing to run, the ball B1 moves to the bearing member 6 from the ball holder 31, leaving a space on the holder 31, and the weight 33 works to restore the ball holder 31 and the stopper 35 to home positions. Moreover, the stopper 39 is released and the ball B3 is stopped by the stopper 35. The ball B1 moves into the guide tube 8 from the bearing member 6, drops toward the resilient ball tosser 5 and is rebounded by the tossser 5 in a given direction to permit a trainee to take toss batting practice. Meanwhile, the ball B2 runs through the meander 22 and finds its way as in the case of ball B1. Therefore, the balls B are tossed successively in order at timed intervals, and the trainee can practice batting independently until there are no balls B, B . . . left in the ball receiver 1.

As described above, the toss batting trainer according to the present invention results in an extremely compact structure and operates utilizing only the potential energy of the ball. Therefore, it is moderate in cost and safe to operate and is obtained easily even by individuals. Moreover, no area having electrical energy available need be selected for batting practice. Further, the trainer can be adjusted properly to supply balls at desired intervals and the intensity, height and direction of the tossed ball may be varied according to the physical constitution and skill of the trainee and the training method. Therefore, an efficient and changeable practice can be realized individually on the toss batting trainer. In addition, each part is formed demountably, which is very convenient for sale, transportation and carrying for use. Thus, the trainer has various excellent features which have never been realized for these kind of implements.

As also illustrated in the drawings, the structure is such that the main rod 42 is divided vertically into top and bottom portions to have the top portion inserted in the bottom portion. A leaf spring 46 is connected between both the portions, and thus devices including the ball receiver 1 supported on the horizontal arm 44 can be pulled down as a whole to facilitate feeding the balls into the ball receiver 1. The ball receiver may be maintained in a lowered position by means of a pull-down handle 47 which engages a latch 48. After the balls are supplied to the ball receiver 1, the handle may be disengaged and the spring 46 will cause the ball receiver to be restored to its normal upper position. A coil spring or the like can be employed instead of the leaf spring 46 according to circumstances.

The trainer has been described herein particularly as specialized for toss batting practice, however, it goes without saying that it can be applied for other ball games, such as tennis.

It will be apparent that many modifications and variations may be effected without departing from the scope of the present invention as defined in the appended claims.

I claim:

1. A ball tossing training device comprising:

a self-supporting stand;

a ball receiver mounted on said stand above ground level;

an angularly adjustable ball track feeder for receiving balls from said receiver, said track feeder having a loading end and a discharge end;

means for adjusting the inclination of said ball track feeder to control the speed of a ball moving therealong;

means for intermittently automatically feeding a single ball at a time along said track feeder;

ball tossing means positioned below said discharge end of said track feeder for deflecting each ball discharged therfrom; and a self-supporting stand including a telescopic rod comprised of an upper portion and a lower portion, said ball receiver and said ball track feeder being attached to said upper portion, and a spring attached at one end to said upper portion and at its opposite end to said lower portion whereby said upper portion may be telescoped down into said lower portion to lower said ball receiver and said ball track feeder and, upon release, the upper portion will spring back to its normal upper position.

2. A device according to claim 1, wherein said means for intermittingly feeding a ball includes a pivotable ball holder for receiving a ball discharged from said track feeder and a first ball stopper operatively associated with said ball holder whereby when said ball holder receives a ball, the ball holder pivots downwardly and causes said first ball stopper to move to a ball releasing position.

3. A device according to claim 2, wherein said means for intermittingly feeding a ball further includes a second ball stopper operatively associated with said first ball stopper whereby movement of said first ball stopper to a ball releasing position to release a first ball causes said second ball stopper to move to a ball retaining position to retain a second ball from movement along said track feeder.

4. A device according to claim 1, which includes a guide tube between said ball holder and said ball tossing means for directing a ball from said ball holder to said ball tossing means.

* * * * *